US012196509B2

(12) United States Patent
Santa et al.

(10) Patent No.: US 12,196,509 B2
(45) Date of Patent: Jan. 14, 2025

(54) EXTRACTOR DEVICE OF A FIREARM

(71) Applicant: Carl Walther GmbH, Ulm (DE)

(72) Inventors: Philipp Santa, Ulm (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 17/868,081

(22) Filed: Jul. 19, 2022

(65) Prior Publication Data

US 2023/0021598 A1 Jan. 26, 2023
US 2023/0417504 A9 Dec. 28, 2023

(30) Foreign Application Priority Data

Jul. 20, 2021 (DE) ..... 10 2021 118 649.8

(51) Int. Cl.
*F41A 15/16* (2006.01)
*F41A 15/12* (2006.01)

(52) U.S. Cl.
CPC ..... *F41A 15/16* (2013.01); *F41A 15/12* (2013.01)

(58) Field of Classification Search
CPC ..... F41A 15/00; F41A 15/12; F41A 15/14; F41A 15/16
See application file for complete search history.

(56) References Cited

U.S. PATENT DOCUMENTS 1,041,410 A * 10/1912 Benet ..... F41A 15/14 42/25
1,571,975 A * 2/1926 Carl ..... F41A 15/14 42/25

(Continued)

FOREIGN PATENT DOCUMENTS

CH 266915 A * 2/1950
CH 276177 A * 6/1951
DE 710619 9/1941

(Continued)

OTHER PUBLICATIONS

UNODC. Firearm Parts and Components. <https://web.archive.org/web/20200515024929/https://www.unodc.org/e4j/zh/firearms/module-2/key-issues/firearms-parts-and-components.html>. May 15, 2020. (Year: 2020).*

(Continued)

*Primary Examiner* — Gabriel J. Klein
(74) *Attorney, Agent, or Firm* — Bachman & LaPointe, P.C.

(57) ABSTRACT

In an extractor device (100) mounted in a breech (300) section of a slide with a lower part with functional elements for interaction with an upper region of a grip part (200) of a firearm with an extractor (110) mounted rotatably about an axis of rotation with an extractor claw (111) provided in the region of an end of the extractor (110) close to the barrel (210) of the firearm and a guide element (112) arranged in the region of an end of the extractor (110) remote from the barrel (210) of the firearm and interacting with an extractor spring (120) biasing the extractor (110), in order to limit a rotational movement of the extractor (110) by contacting a cartridge (400) newly supplied from a magazine. The guide element (112) is biased in the direction of a control link (130) by the extractor spring (120) arranged in an inner blind hole (113) of the extractor, said control link being configured in an extractor pocket (310) in the breech section (300) and forming a bearing of the extractor.

15 Claims, 5 Drawing Sheets

(56) References Cited

U.S. PATENT DOCUMENTS

| | | | | | |
|---|---|---|---|---|---|
| 1,682,704 | A | * | 8/1928 | Loomis | F41A 15/14 42/25 |
| 1,889,099 | A | * | 11/1932 | Loomis | F41A 15/12 42/25 |
| 2,198,610 | A | * | 4/1940 | Garand | F41A 15/14 42/25 |
| 2,711,041 | A | * | 6/1955 | Harvey | F41A 15/14 42/25 |
| 2,717,464 | A | | 9/1955 | Marcati | |
| 2,780,881 | A | * | 2/1957 | Crittendon | F41A 15/16 42/25 |
| 2,984,924 | A | * | 5/1961 | Reed | F41A 15/14 42/25 |
| 3,021,634 | A | * | 2/1962 | Johnson | F41A 15/14 42/25 |
| 5,604,326 | A | | 2/1997 | Lescure | |
| 5,678,340 | A | * | 10/1997 | Moon | F41A 15/12 42/25 |
| 6,260,297 | B1 | | 7/2001 | Schmees | |
| 8,028,454 | B1 | | 10/2011 | Pontillo, II | |
| 8,966,800 | B1 | | 3/2015 | Olson | |
| 9,518,791 | B1 | | 12/2016 | Heizer et al. | |
| 9,746,283 | B2 | | 8/2017 | Braun | |
| 2006/0185212 | A1 | | 8/2006 | Curry et al. | |
| 2011/0041680 | A1 | | 2/2011 | Smirnov | |
| 2014/0196339 | A1 | | 7/2014 | Zukowski et al. | |
| 2016/0231075 | A1 | | 8/2016 | Wolf | |
| 2017/0261279 | A1 | | 9/2017 | Lee | |
| 2018/0087857 | A1 | | 3/2018 | Davis et al. | |
| 2021/0222978 | A1 | * | 7/2021 | Bachstein | F41A 15/12 |
| 2021/0318085 | A1 | | 10/2021 | Kling et al. | |
| 2021/0364244 | A1 | | 11/2021 | Kling et al. | |
| 2023/0160651 | A1 | * | 5/2023 | Mortsch | F41A 15/14 42/25 |

FOREIGN PATENT DOCUMENTS

| | | | | |
|---|---|---|---|---|
| DE | 710619 | C | * | 9/1941 |
| DE | 7124565 | U | | 11/1971 |
| DE | 19843294 | A1 | | 3/2000 |
| EP | 0786640 | A1 | | 7/1997 |
| GB | 500621 | A | | 2/1939 |
| GB | 637264 | A | * | 5/1950 |

OTHER PUBLICATIONS

German Office Action dated Dec. 9, 2020 for German Patent Application No. 10 2020 108 231.2.

Exploded drawing and parts list: "Creed", Jun. 8, 2016, Carl Walther GmbH, Ulm, Germany.

Exploded drawing and parts list: "PPQ", Jan. 11, 2018, Carl Walther GmbH, Ulm, Germany.

Exploded drawing and parts list: "Ppx M1", Jul. 28, 2014, Carl Walther GmbH, Ulm, Germany.

US Office action dated Mar. 17, 2022 for U.S. Appl. No. 17/159,438.

"Spare Parts Catalogue: SFP9-SF Pistol", Sep. 2015, Heckler & Koch GmbH, Oberndorf, Germany.

German Office Action dated Feb. 7, 2022 for German Patent Application No. 102021118649 (with electronic translation).

* cited by examiner

EXTRACTOR DEVICE OF A FIREARM

CROSS-REFERENCE TO RELATED APPLICATION

Priority is claimed of German Patent Application No. DE 10 2021 118 649.8, filed Jul. 20, 2021, and entitled "Extractor Device of a Firearm", the disclosure of which is incorporated by reference herein in its entirety as if set forth at length.

BACKGROUND

The invention relates to an extractor device mounted in a breech section of a slide with a lower part with functional elements for interaction with an upper region of a grip part (frame) of a firearm with an extractor mounted rotatably about an axis of rotation with an extractor claw provided in the region of an end of the extractor close to the barrel of the firearm and a guide element arranged in the region of an end of the extractor remote from the barrel of the firearm and interacting with an extractor spring biasing the extractor, in order to limit a rotational movement of the extractor by contacting a cartridge newly supplied from a magazine.

In the prior art, the axis of rotation of the extractor in firearms is realized by means of a separate axis, based on the example of the Walther PPQ. However, this makes it more difficult for a strong closing torque to be achieved at the extractor when a fired cartridge is being removed, something that can only be compensated for by means of a correspondingly oversized extractor spring.

SUMMARY

The problem addressed by the invention is therefore that of creating an extractor device for a firearm, the structural form of which is reduced in size compared with the extractor devices known in the art, and the functional safety of which is improved compared with the extractor devices known in the art.

For a device of the kind referred to above, this problem is solved according to the invention, in that the guide element is biased in the direction of a control link by an extractor spring arranged in an inner blind hole of the extractor, said control link being configured in an extractor pocket in the breech section and forming a bearing of the extractor.

Preferred embodiments of the invention are the subject matter of the dependent claims, the elements of which act as a further improvement in the approach to solving the problem underlying the invention.

In the case of the device according to the invention, by means of the combination of features, wherein the guide element is biased in the direction of a control link by an extractor spring arranged in an inner blind hole of the extractor, which control link is configured in an extractor pocket in the breech section and forming a bearing of the extractor, it is achieved, in particular, that the use of a separate axis for rotation of the extractor is dispensable.

The relinquishment of a physically formed axis of rotation of the extractor and realization of an axis of rotation of the extractor configured according to the invention without an explicit axis of rotation thereby allows the extractor to be moved very close to the barrel of the firearm or to a firing pin bore of the firearm, as a result of which a closing torque of the extractor which is improved by comparison with the prior art is achieved. At the same time, the fact that the extractor is moved very close to the firing pin bore means that there is no need for the formation of openings to the firing pin bore, which are traditionally a cause of contamination of the firing pin bore, meaning that according to the invention the overall contamination of the firing pin bore is reduced by comparison with embodiments according to the prior art.

The arrangement of the extractor spring within the extractor in the longitudinal direction of the firearm means that the installation space of the extractor is actually minimized.

The advantages of the invention come to bear in particular in the case of small calibers, since with small calibers the area of space available to accommodate an axis of rotation formed as a shaft between the firing pin bore and the extractor arranged laterally to the firing pin bore is likewise small in size, on account of the comparatively short distance of a longitudinal axis arranged in continuation of the longitudinal axis of the firing pin bore of a cartridge arranged in the cartridge chamber of the firearm from the edge of the cartridge contacted by the extractor claw.

Furthermore, a design of an extractor device according to the present invention simplifies production of a breech section through the formation of a highly simplified shape and function of the extractor pocket by comparison with the prior art and by dispensing with roughly 25% of components compared with traditional solutions. The device remains detachable by a user.

In accordance with a first preferred embodiment of the device according to the invention, it is provided that the guide element is mounted in a reproducibly movable manner within the bore of the extractor in an axial direction of said bore.

In accordance with another preferred embodiment of the device according to the invention, the control link is configured as part of the inner boundary wall of the extractor pocket formed in the breech section and creating a bearing of the extractor.

The guide element is preferably configured as a pressure pin, whereof the end remote from the extractor spring has a planar end face arranged perpendicularly to the longitudinal axis or a curved end face, which is movably mounted in coherent fashion in a control link configured as a pan.

Furthermore, the pressure pin preferably has a substantially cylindrical form, wherein the end of the pressure pin remote from the extractor spring is configured on a shaper head part, the diameter of which is smaller by comparison with that of the regions close to the extractor spring.

In accordance with a further preferred embodiment of the device according to the invention, the end of the pressure pin close to the extractor spring is provided with an axially oriented pin, the diameter of which is smaller compared with the remaining part of the pressure pin, so that said pin can be introduced into the hollow of an open end of an extractor spring configured as a spiral spring.

In accordance with an important preferred embodiment of the device according to the invention, the extractor pocket has a recess as the bearing for a pedestal attached to the extractor, the undersurface of said pedestal remote from the guide element standing opposite a bottom surface of the recess close to the barrel, and the front surface of said pedestal close to the extractor claw merging with the undersurface in the form of a curved shaper head, wherein the shaper head is supported both against the bottom surface of the recess and against a lateral surface of the recess close to the extractor claw and opposite the front surface of the pedestal and forms an axis of rotation of the extractor, which allows the extractor to rotate in relation to the breech section.

Within the meaning of optimized functionality of the device according to the invention, it is thereby essential for the axis of rotation of the extractor and the attachment surface of the extractor claw contacting a circumferential groove of a cartridge to be arranged at the same distance from the central axis of the barrel.

The shaper head of the pedestal is biased according to the invention by means of the guide element through the action of the extractor spring in the direction of the lateral surface of the recess lying opposite the front surface of the pedestal.

Furthermore, when the extractor is in an inoperative position, in which the extractor claw contacts a cartridge located in the cartridge chamber of the firearm, the undersurface of the pedestal is preferably arranged at an acute angle to the bottom surface of the recess lying opposite.

In this case, this angle corresponds to the angle about which the longitudinal axis of the extractor pivots when the end face of the pressure pin slides in the pan from one end of the pan remote from the barrel to an end of the pan close to the barrel.

In accordance with a further important preferred embodiment of the device according to the invention, the undersurface of the pedestal of the extractor remote from the guide element and the front surface of the pedestal of the extractor close to the extractor claw are arranged at an acute angle to one another, whereas the bottom surface of the recess close to the barrel and the side surface of the recess lying opposite the front surface of the pedestal, close to the extractor claw, are arranged at a right angle to one another.

BRIEF DESCRIPTION OF THE DRAWINGS

The device according to the invention is explained below with the help of a preferred embodiment which is depicted in the figures of the drawing. In the drawing.

DETAILED DESCRIPTION

Figure 5:
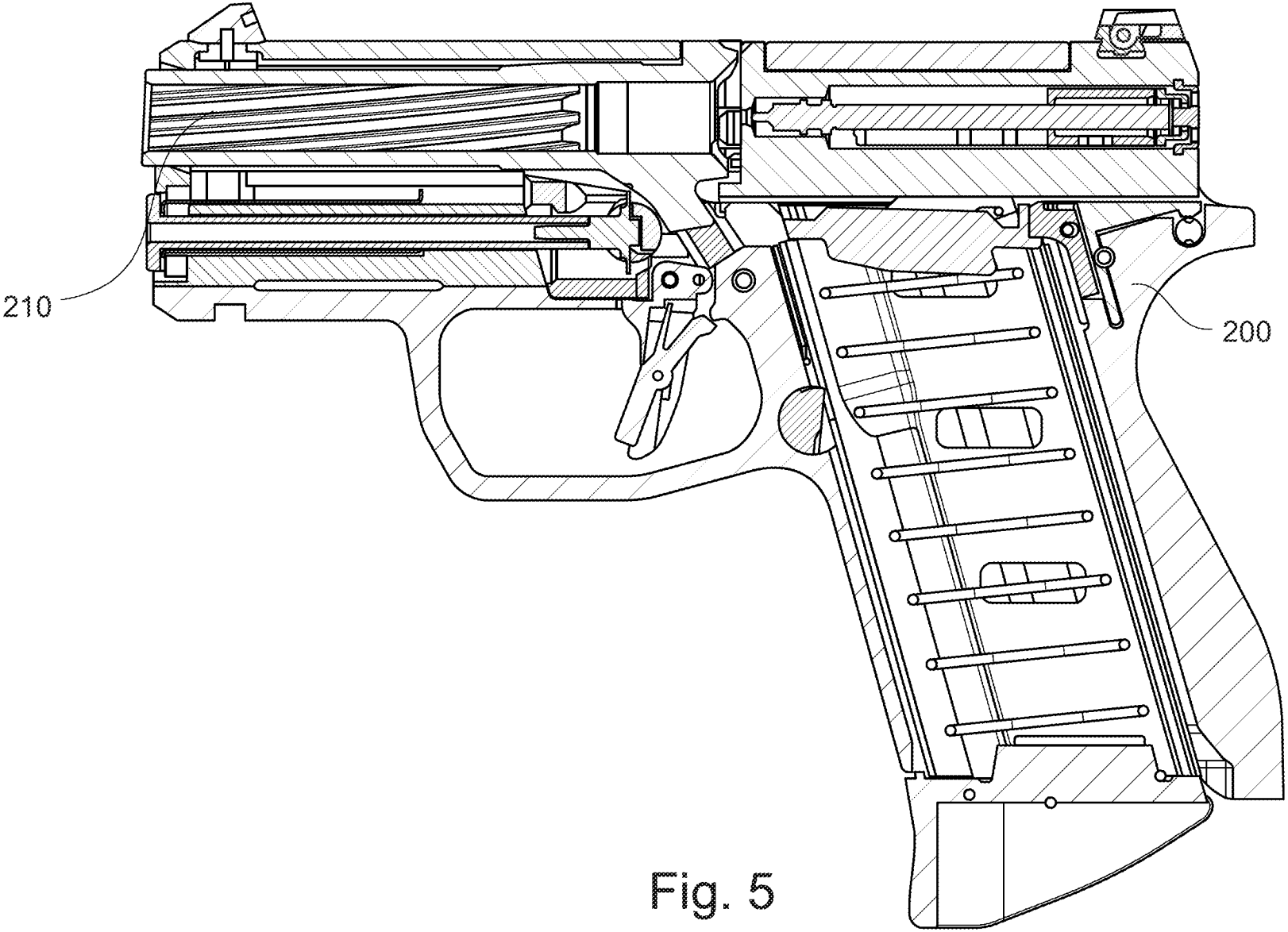
FIG. 5 is a vertical longitudinal sectional view of a firearm.

The extractor device 100 according to the invention depicted in FIGS. 1 to 4 is mounted in a breech section 300 of a slide with an underpart with functional elements for interaction with an upper region of a grip part (frame) 200 of a firearm and contains an extractor 110 mounted rotatably about an axis of rotation with an extractor claw provided in the region of an end of the extractor 110 close to the barrel 210 (FIG. 5) of the firearm and a guide element 112 arranged in the region of an end of the extractor 110 remote from the barrel 210 of the firearm and interacting with an extractor spring 120 biasing the extractor 110, in order to limit a rotational movement of the extractor 110 by contacting a cartridge 400 newly supplied from a magazine. Thus the combined extractor 110, spring 120, and pin 112 form the extractor device or assembly.

The guide element 112 in this case is biased in the direction of a control link 130 by an extractor spring 120 arranged in an inner bore of the extractor 110, said control link being configured in an extractor pocket 310 in the breech section 300 (e.g., cast) and forming a bearing of the extractor 110. The guide element 112 in this case is mounted in a reproducibly movable manner within the bore of the body of the extractor 110 in an axial direction of the bore.

The control link 130 is configured as part of the inner boundary wall of the extractor pocket 310 formed in the breech section 300 and creating a bearing of the extractor 110.

The guide element 112 is configured as a pressure pin (spring pin) 112, whereof the end 114 remote from the extractor spring 120 has a curved end face 1141, which is movably mounted in coherent fashion in a control link 130 configured as a pan 130.

Figure 1:
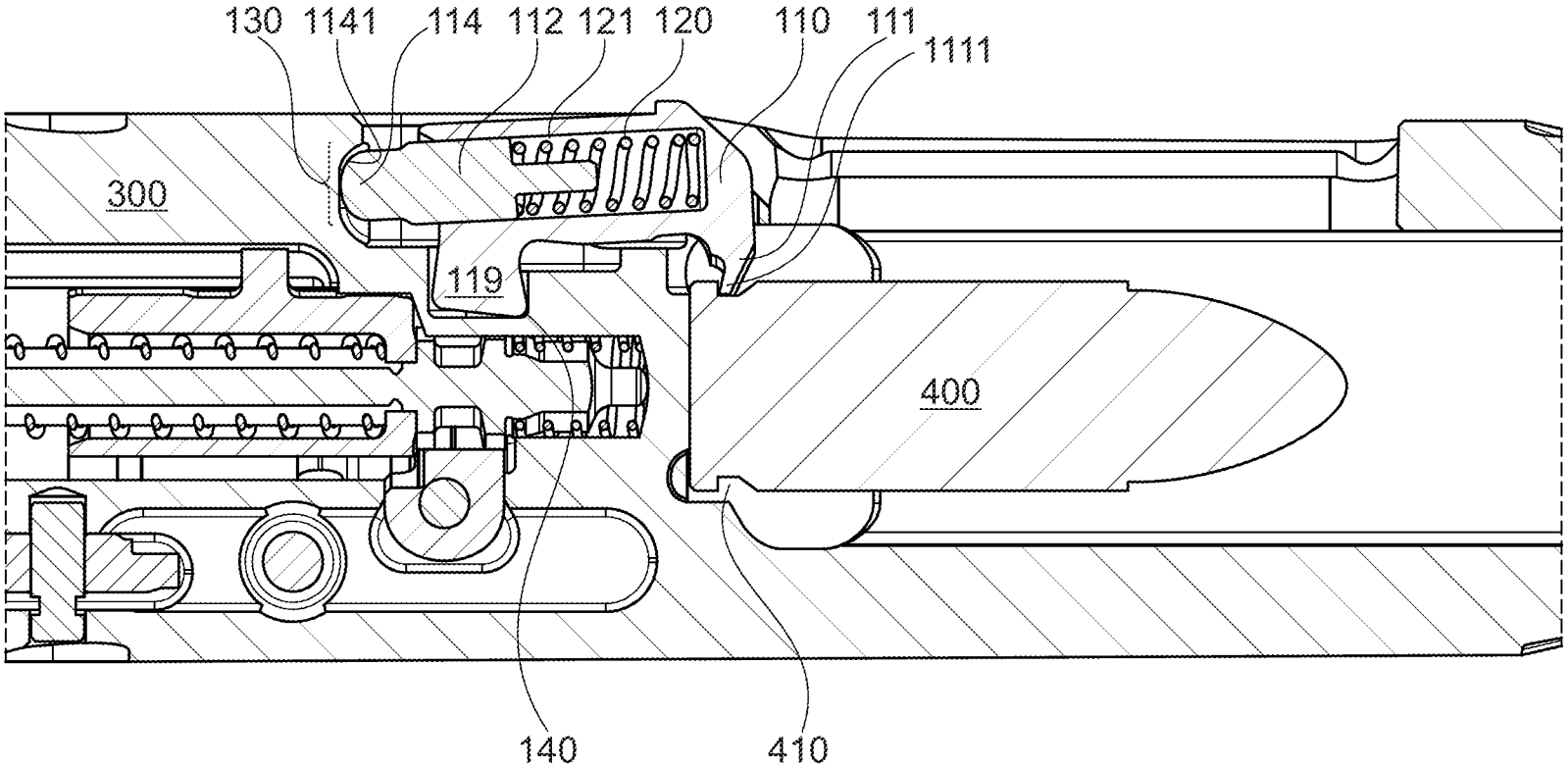
FIG. 1 shows a a portion of a pistol slide according to the invention in a state with cartridge (barrel omitted), in a transverse (horizontal) cross-sectional view.
Figure 2:
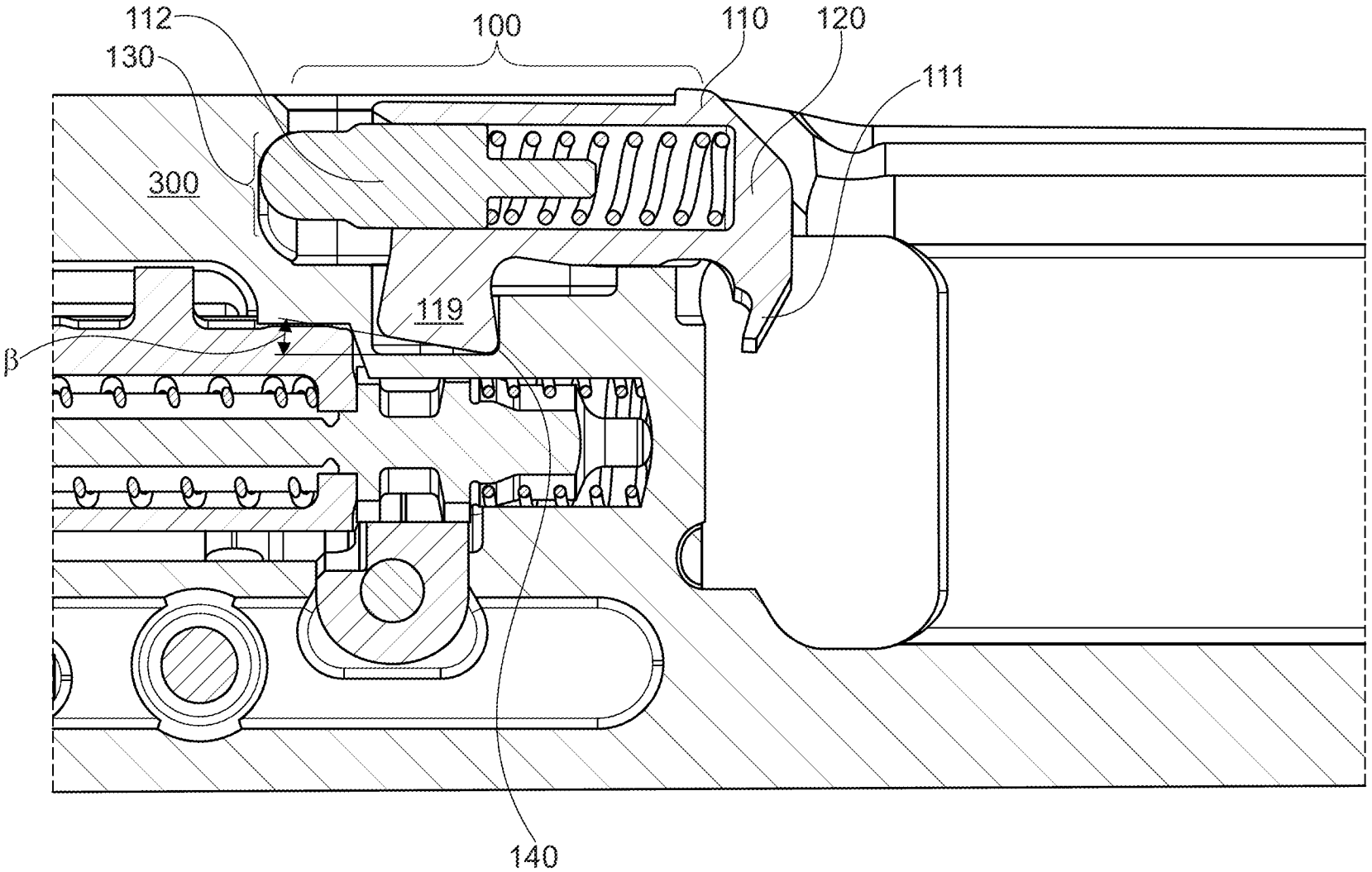
FIG. 2 shows the slide portion of FIG. 1 in a state without cartridge, in a transverse cross-sectional view.
Figure 3:
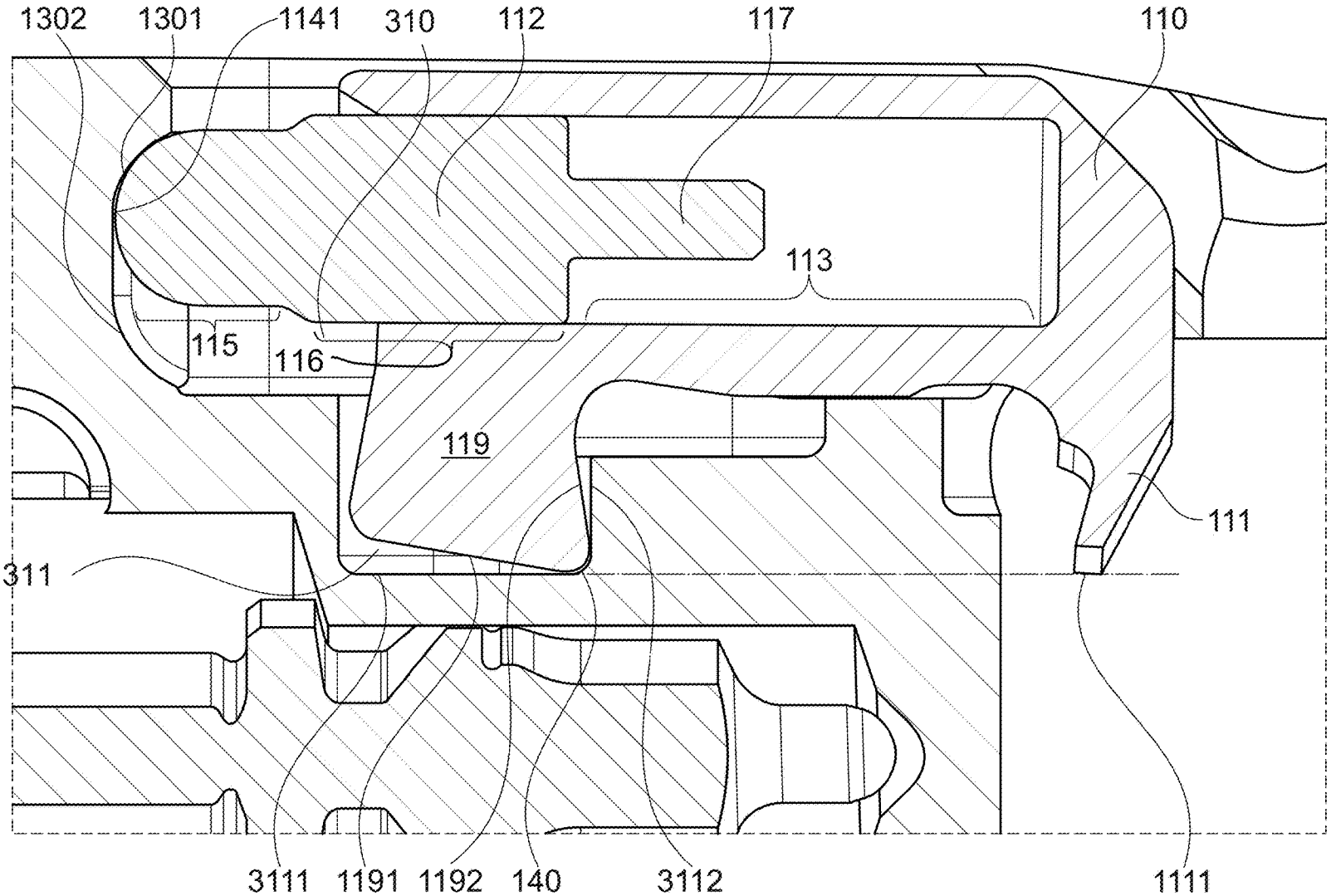
FIG. 3 shows a detail depiction of the slide portion of FIG. 1 (extractor spring omitted) in a state without cartridge, in a transverse cross-sectional view.
Figure 4:
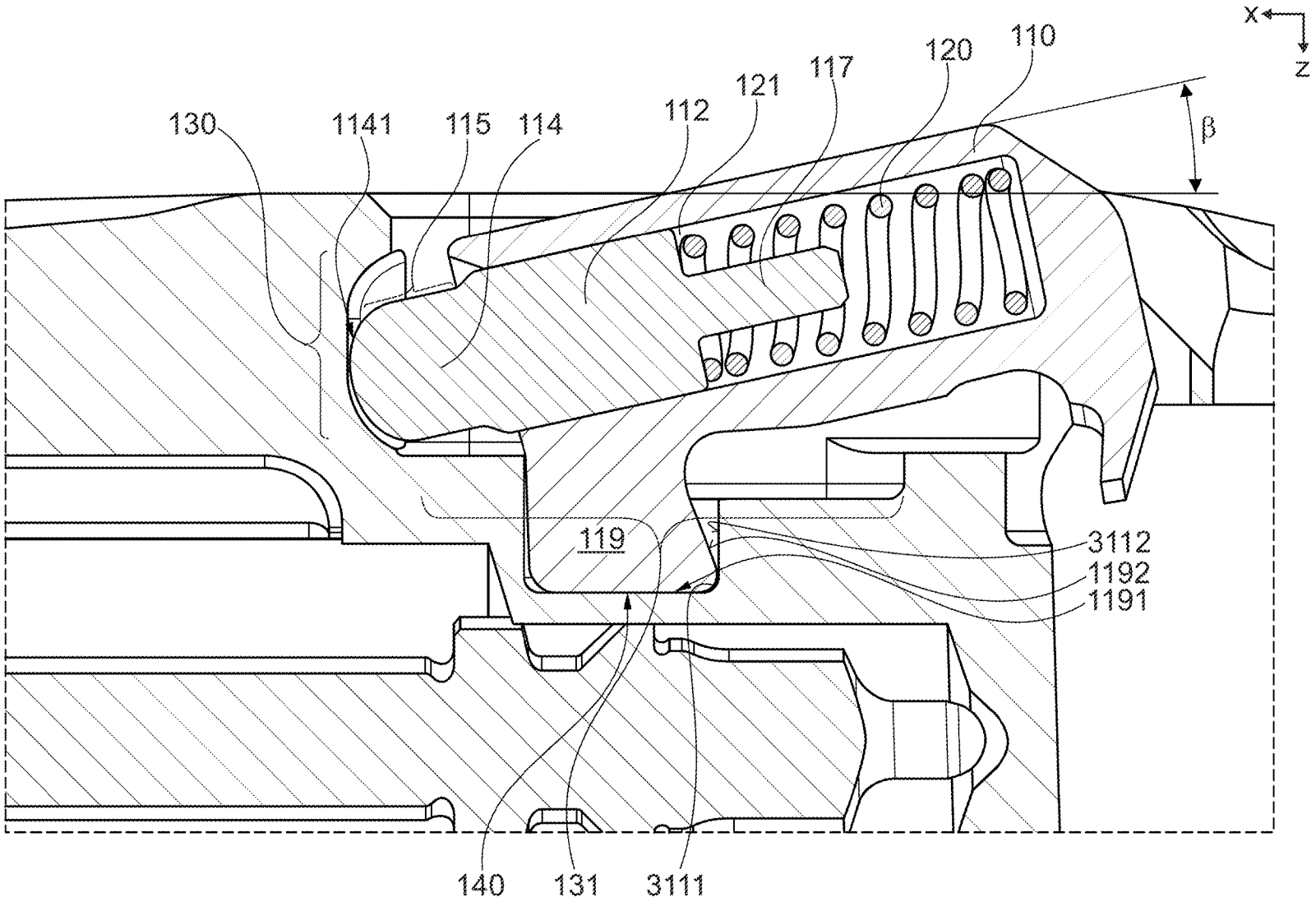
FIG. 4 shows the slide portion of FIG. 1 in a state involving engagement with a new cartridge (omitted), in a transverse cross-sectional view.

The pressure pin 112 has a cylindrical form, wherein the end 114 of the pressure pin 112 remote from the extractor spring 120 is configured on a shaper head part 115, the diameter of which is smaller by comparison with that of the regions 116 (FIG. 3) close to the extractor spring 120. FIG. 3 shows a shoulder at a junction of the shaper head part 115 and the region 116.

The end of the pressure pin 112 close to the extractor spring 120 is provided with an axially oriented pin 117, the diameter of which is smaller compared with the remaining part of the pressure pin 112, so that the pin 117 can be introduced into the hollow of an open end 121 of an extractor spring 120 configured as a spiral spring.

The extractor pocket 310 has a recess 311 as the bearing for a pedestal 119 projecting from the body of the extractor 110, whereof the undersurface 1191 remote from the guide element 112 stands opposite a bottom surface 3111 of the recess 311 close to the barrel, and whereof the front surface 1192 close to the extractor claw 111 merges with the undersurface 1191 in the form of a curved shaper head 140, wherein the shaper head 140 is supported both against the bottom surface 3111 of the recess 311 and against a lateral surface 3112 of the recess 311 close to the extractor claw 111 and opposite the front surface 1192 of the pedestal 119 and forms an axis of rotation of the extractor 110, which allows the extractor 110 to rotate in relation to the breech section 300.

The axis of rotation of the extractor 110 and the attachment surface of the extractor claw 111 contacting a circumferential groove of a cartridge are arranged at the same distance from the central axis of the barrel.

The shaper head 140 of the pedestal 119 is biased by means of the guide element 112 through the action of the extractor spring 120 in the direction of the lateral surface 3112 of the recess 311 lying opposite the front surface of the pedestal 119.

When the extractor 110 is in an inoperative position, in which the extractor claw 111 contacts a cartridge 400 located in the cartridge chamber 220 of the firearm, the undersurface 1191 of the pedestal 119 is arranged at an acute angle to the bottom surface 3111 of the recess 311 lying opposite.

This angle corresponds to the angle, about which the longitudinal axis of the extractor 110 pivots when the end face 1141 of the pressure pin 112 slides radially (relative to the barrel axis) in the pan 130 from one end 1301 of the pan radially remote from the barrel 210 to an end 1302 of the pan radially close to the barrel 210. FIG. 3 shows the ends as concave.

The undersurface 1191 of the pedestal 119 of the extractor 110 remote from the guide element 112 and the front surface 1192 of the pedestal 119 of the extractor 110 close to the extractor claw 111 are arranged at an acute angle to one another, whereas the bottom surface 3111 of the recess 311 close to the barrel and the lateral surface 3112 of the recess 311 lying opposite the front surface 1192 of the pedestal 119, close to the extractor claw 111, are arranged at a right angle to one another.

The exemplary embodiment of the invention explained above serves simply to provide greater understanding of the inventive teaching embodied in the claims, which is not limited as such by the exemplary embodiment.

LIST OF REFERENCE SIGNS

Below is a list of reference signs used in the drawings:

100 extractor device
110 extractor body
111 extractor claw
112 guide element or pressure pin
113 blind hole
114 remote end
115 shaper head part
116 close region
117 pin
119 pedestal
120 extractor spring
121 open end
130 control link or pan
140 shaper head
200 grip part
210 barrel
220 cartridge chamber
300 breech section
310 extractor pocket
311 recess
400 cartridge
410 circumferential groove
1141 end face
1191 remote undersurface
1192 close front surface
1301 remote pan end
1302 close pan end
3111 bottom surface
3112 lateral surface

What is claimed is:

1. Extractor device (100) mounted in a breech (300) with a lower part in sliding interaction with an upper region of a grip part (200) of a firearm with an extractor (110) mounted rotatably about an axis of rotation with an extractor claw (111) provided in a region of a first end of the extractor (110) and a guide element (112) arranged in a region of a second end of the extractor (110), relative to the first end, the second end being remote from a barrel (210) of the firearm and interacting with an extractor spring (120) biasing the extractor (110), in order to limit a rotational movement of the extractor (110) caused by contact with a cartridge (400) newly supplied from a magazine, wherein:

the guide element (112) is biased in a direction of a control link (130) by the extractor spring (120) arranged in an inner blind hole (113) of the extractor (110), said control link being configured in an extractor pocket (310) in the breech (300) and forming a bearing of the extractor (110);

the extractor pocket (310) has a recess (311) as a bearing for a pedestal (119) attached to the extractor (110), an undersurface (1191) of said pedestal standing opposite a bottom surface (3111) of the recess (311), and a front surface (1192) of said pedestal facing the extractor claw (111) merging with the undersurface (1191) in the form of a curved shaper head (140);

the shaper head (140) is supported both against the bottom surface (3111) of the recess (311) and against a front surface (3112) of the recess (311) opposite the front surface (1192) of the pedestal (119) and forms an axis of rotation of the extractor (110), which allows the extractor (110) to rotate in relation to the breech (300);

the guide element (112) is configured as a pressure pin (112) having an end (114) opposite from the extractor spring (120) and having a curved end face (1141) and which is movably mounted in coherent fashion in a control link (130) configured as a pan (130); and the pressure pin (112) has a substantially cylindrical form, wherein the end (114) of the pressure pin (112) is a shaper head part (115), the diameter of which is smaller by comparison with that of a region (116) of the pressure pin closer to the extractor spring with a shoulder at a junction of the shaper head part and the region of the pressure pin closer to the extractor spring.

2. The device (100) according to claim 1, characterized in that the guide element (112) is mounted in a reproducibly movable manner within a blind bore (113) of the extractor (110) in an axial direction of said blind bore (113).

3. The device (100) according to claim 1, characterized in that the control link (130) is configured as part of an inner boundary wall of the extractor pocket (310) formed in the breech (300) and creating a bearing of the extractor (110).

4. The device (100) according to claim 1, characterized in that a forward end of the pressure pin (112) is formed by an axially oriented pin (117), the diameter of which is smaller compared with a remaining part of the pressure pin (112), so that said axially oriented pin (117) can be introduced into a hollow of an open end (121) of an extractor spring (120) configured as a spiral spring.

5. The device (100) according to claim 1, characterized in that the axis of rotation of the extractor (110) and an attachment surface (1111) of the extractor claw (111) contacting a circumferential groove (410) of a cartridge are arranged at the same distance from the central axis of the barrel.

6. The device (100) according to claim 1, characterized in that the shaper head (140) has a sharp lower edge.

7. A firearm comprising:

a frame;

a slide;

a barrel;

an extractor assembly (100) having:

an extractor (110) mounted to the slide rotatably about an axis of rotation and having:

a first and and a second end, the first end closer to the barrel than the second end; and an extractor claw (111) at the first end of the extractor (110);

a guide element (112) protruding from the second end of the extractor (110); and an extractor spring (120) in a hole (113) of the extractor (110) biasing the extractor (110), wherein:

the guide element (112) is biased in the direction of a control link (130) by the extractor spring (120), said control link being a surface of an extractor pocket (310) in a breech section (300) of the slide and forming a bearing of the extractor;

first and second ends of the surface of the extractor pocket are concave;

the guide element has a region (116) for sliding in the hole and a head section (115) of lower diameter than the region (116);

the head section has a rounded end (114); and a shoulder is at a junction of the head and the region (116).

8. The firearm of claim 7 wherein:

the hole (113) is a blind hole.

9. A firearm comprising:

a frame;

a slide;

a barrel;

an extractor assembly (100) having:

an extractor (110) mounted to the slide rotatably about an axis of rotation and having:

a first and and a second end, the first end closer to the barrel than the second end; and an extractor claw (111) at the first end;

a guide element (112) protruding from the second end;

an extractor spring (120) biasing the guide element from the extractor (110) to contact a surface of an extractor pocket (310) in a breech section (300) of the slide, wherein:

the extractor pocket is shaped to allow an end (114) of the guide element to slide between a first end (1301) and a second end (1302) of a bearing section of the extractor pocket, the bearing section first end radially remote of the barrel relative to the bearing section second end; and the bearing section first and second ends are concave.

10. The firearm of claim 9 wherein:

the spring is a coil compression spring.

11. The firearm of claim 9 wherein:

an axis of rotation of the extractor (110) and an attachment surface (1111) of the extractor claw (111) for contacting a circumferential groove (410) of a cartridge are at the same distance from the central axis of the barrel when the end (114) of the guide element contacts the first end (1301) of the bearing section.

12. A firearm comprising:

a frame;

a slide;

a barrel;

an extractor assembly (100) having:

an extractor (110) mounted to the slide rotatably about an axis of rotation and having:

a first and and a second end, the first end closer to the barrel than the second end; and an extractor claw (111) at the first end;

a guide element (112) protruding from the second end;

an extractor spring (120) biasing the guide element from the extractor (110) to contact a surface of an extractor pocket (310) in a breech section (300) of the slide, wherein:

the extractor pocket is shaped to allow an end (114) of the guide element to slide between a first end (1301) and a second end (1302) of a bearing section of the extractor pocket, the bearing section first end radially remote of the barrel relative to the bearing section second end; and an axis of rotation of the extractor (110) and an attachment surface (1111) of the extractor claw (111) for contacting a circumferential groove (410) of a cartridge are at the same distance from the central axis of the barrel when the end (114) of the guide element contacts the first end (1301) of the bearing section.

13. The firearm of claim 12 wherein:

the firearm is a pistol.

14. The firearm of claim 13 wherein:

the extractor spring (120) is a coil compression spring in a hole (113) of the extractor (110).

15. The firearm of claim 14 wherein:

the hole is a blind hole.

* * * * *